US007367201B1

(12) United States Patent
Doring et al.

(10) Patent No.: US 7,367,201 B1
(45) Date of Patent: May 6, 2008

(54) AIR CONDITIONING FAN

(76) Inventors: Alejandro Doring, 2750 Costebelle Dr., La Jolla, CA (US) 92037; Laura Oberfeld, 2750 Costebelle Dr., La Jolla, CA (US) 92037

( * ) Notice: Subject to any disclaimer, the term of this patent is extended or adjusted under 35 U.S.C. 154(b) by 576 days.

(21) Appl. No.: 11/088,637

(22) Filed: Mar. 23, 2005

Related U.S. Application Data

(60) Provisional application No. 60/556,617, filed on Mar. 24, 2004.

(51) Int. Cl.
*F25D 17/06* (2006.01)

(52) U.S. Cl. ..... 62/419; 62/426

(58) Field of Classification Search ..... 62/190, 62/314, 414, 419, 426, 467
See application file for complete search history.

(56) References Cited

U.S. PATENT DOCUMENTS 2,181,436 A * 11/1939 Madden ..... 237/6
3,102,961 A * 9/1963 Kuehn, III ..... 290/37 R
3,914,955 A * 10/1975 McCullough ..... 62/237
4,339,743 A * 7/1982 Ludwig ..... 338/206
6,224,335 B1 * 5/2001 Parisi et al. ..... 415/206
6,270,559 B1 * 8/2001 Daneshfar ..... 96/262
6,746,215 B2 * 6/2004 Tani et al. ..... 417/366

FOREIGN PATENT DOCUMENTS

JP 404136637 A * 5/1992

* cited by examiner

*Primary Examiner*—Mohammad M. Ali
(74) *Attorney, Agent, or Firm*—Thomas I. Rozsa

(57) ABSTRACT

An air conditioning fan apparatus including a ceiling fan unit, an air conditioning unit and a motor unit, all suspended as an integral device to a ceiling inside a user's home or office. The ceiling fan unit includes a multiplicity of fan blades each having evaporator tubing running inside. The air conditioning unit cools Freon gas that circulates through the fan blades for cooling the fan blades as they circulate the indoor air which in turn cools the air being circulated. The motor unit rotates the entire air conditioning unit and the fan blades together. A circular channel is further provided around the outside perimeter of the fan blades for collecting the moisture condensate formed on the fan blades as a result of the operation of the air conditioning unit.

18 Claims, 2 Drawing Sheets

AIR CONDITIONING FAN

This application claims priority of U.S. Provisional Patent Application Ser. No. 60/556,617 filed on Mar. 24, 2004.

BACKGROUND OF THE INVENTION

1. Field of the Invention

The present invention generally relates to the field of air conditioning units and air moving fans, and more particularly to the field of indoor ceiling fans with cooling functions.

2. Description of the Prior Art

Air conditioning products and air moving fans are widely used in many homes and offices. The primary purpose of air moving fans is to improve the air circulation, while the primary purpose of air conditioning units is to adjust the temperature and air quality.

There are many different types of air moving fans, including floor fans, table fans, ceiling fans, etc. A typical ceiling fan is suspended below a ceiling of a room and has a motor unit and rotatable blades. There are also many different types of air conditioners, including central units, free stand units, window units, etc. However, there is currently no commercial products that combine an air conditioning unit with a ceiling fan.

The following references are examples of prior art in this field of art:

U.S. Pat. No. 3,612,168 issued to Peterson on Oct. 12, 1971 for "Rotatable Heat Transfer means" discloses a rotatable heat transfer fan having a plurality of radially extending blades secured to a rotatable hub with fluid inlet and outlet passages. A plurality of radially extending heat exchange tubes are spaced from opposite faces of the blades by a plurality of radially spaced fins secured to the blades and the tubes. The inner ends of the tubes are connected to the inlet and outlet passages in the hub whereby a heat exchange fluid may be circulated through the tubes. The outer ends of each tube is fluidly connected to a tubular ring secured to the outer peripheral portions of the blades. The tubular ring defines a circumferentially extending annular fluid passage which equalizes the fluid pressure on all of the tubes. A pump is operable to force fluid through the tubes.

U.S. Pat. No. 4,598,632 issued to Johnson on Jul. 8, 1986 for "Air-Driven Ceiling Fan" (reissued as Re. 33,347 on Sep. 25, 1990) disclose an air-driven ceiling fan which uses air from the duct work system of a home such as the central air-conditioning system to harness that air flow and drive the ceiling fan. The ceiling fan has a plurality of blades which are spaced from the ceiling and upon a common shaft in a horizontal plane. Air flow through the duct work drives a squirrel cage blower which is mounted about a vertical axis so that air flow through the duct work also drives the squirrel cage blower and the ceiling fan.

U.S. Pat. No. 4,854,374 issued to Harrison on Aug. 8, 1989 for "Temperature Controlling Apparatus" discloses an apparatus for heating or cooling ambient air in the form of a temperature controlling propeller. The apparatus has a plurality of blades arranged around a rotatable hub, the blades carrying cells containing a heat retaining material. The cells are mounted in openings provided in the blades and retained therein. A thermometer may be mounted on the hub to monitor air temperature. The propeller is heated or chilled prior to mounting on a driven shaft. When the propeller is rotated by the shaft, it simultaneously circulates and heats or cools the surrounding air.

U.S. Pat. No. 5,097,674 issued to Imaiida on Mar. 24, 1992 for "Air Conditioning Apparatus" discloses an air conditioning apparatus with an air conditioner embedded in a ceiling of a room having an air inlet port opening to the room, a heat exchanger and a blower. A duct box is connected to the air conditioner through a blow-off casing provided on the duct box to project air into the room via an air outlet opening to the room. A fan is disposed on a lower portion of the blow-off casing. A diffuser is provided for redirecting conditioning air from a vertical direction to a substantially horizontal direction. The fan is rotatable forward and backward and includes an outer rotor motor and a plurality of blades fixedly attached to an outer peripheral surface of an outer rotor of the motor.

U.S. Pat. No. 5,524,450 issued Chen on Jun. 11, 1996 for "Air-Conditioning Ceiling Fan" discloses an air-conditioning ceiling fan including a body portion provided with an electric motor and a plurality of blades, an evaporator mounted on the body portion, a hollow supporter adapted to be fixedly mounted on a ceiling and having a tubular lower end depending downwardly through the evaporator, a water tray arranged under the evaporator, a condensing case including a compressor, a condenser and an exhaust fan, where the compressor is connected between the condenser and the evaporator via refrigerant pipes, the condenser is connected with the evaporator via refrigerant pipes. There is also provided a connecting pipe connecting the hollow supporter and the condensing case.

U.S. Pat. No. 5,675,986 also issued to Chen on Oct. 14, 1997 for "Air-Conditioning Fan" discloses an air-conditioning fan having a stand, a compressor mounted within the stand, a motor arranged on an upper end of the stand, an impeller fixedly mounted on an output axle of the motor, an evaporator sleeved over the motor, and a condensing case provided with a condenser, an exhaust fan mounted in front of the condenser, and a plurality of air inlets, the condenser being connected with the compressor and the evaporator.

U.S. Pat. No. 5,564,980 issued to Becker on Oct. 15, 1996 for "Room Air Quality Conditioning System" discloses an air circulation system having an inflow system which includes a tube enclosure or cowl suspended from a ceiling of a room or from a roof above the room. The tube enclosure or cowl is fitted with a ceiling fan. An air supply unit external to the room (e.g., outdoors) includes an in flow fan connected to air supply duct and a variable air volume box having an inlet connected to the air supply duct and an outlet connected to the interior of the tube enclosure or cowl. The system also includes an outflow system which includes an exhaust grill which may be either suspended from the ceiling or be fitted to the wall of the room. An exhaust riser duct is connected to the exhaust grill. An exhaust fan is connected to the outlet from the exhaust riser. The exhaust fan is operated in conjunction with the inflow fan to exhaust, via the outflow system, substantially all the volume of air inflowing thorough the air inflow system into the inside room through the outflow system.

U.S. Pat. No. 5,887,785 issued on Mar. 30, 1999 for "Apparatus For Qualitative And Quantitative Air Management For Ceiling Fans" and U.S. Pat. No. 6,244,820 B1 issued on Jun. 12, 2001 for "Method And Apparatus For Multifunctional Fan" both to Yilamz disclose a ceiling fan having a cooling unit, a heating unit, a filtering device and a secondary multidirectional fan for improving air quality to fulfill users' specific needs for a given area.

U.S. Pat. No. 6,030,287 issued to Core on Feb. 29, 2000 for "System For Distributing Air Through A Ceiling In A Room" discloses a system for distributing air through an opening in a ceiling into a room, where the ceiling is supported by spaced apart joists or other ceiling structural members, and the air is supplied by a duct located above the ceiling. The system has a plenum having an open top connected to the duct and an open bottom in communication with the ceiling opening. A support bar extends through the plenum and secured at its opposed ends to ceiling structural member. A motor hanger is secured to the support bar. An air diffuser is positioned in communication with the plenum open bottom. A fan motor is supported to the lower end of the motor hanger. A plurality of generally horizontally extending fan blades are attached to and rotated by the motor. Air is passed from the duct through the plenum and diffuser into the room, while the distribution of the air is augmented by the fan blades as rotated by the motor.

U.S. Pat. No. 6,120,247 issued to Wheeler on Sep. 19, 2000 for "Room Cooling Fan Apparatus" discloses an air circulating fan assembly having a fan motor and fan blades rotated by the motor, a fluid reservoir and a thermoelectric cooler for cooling the water in the reservoir, and ducting associated with the blades to conduct fluid from the reservoir to heat exchange structure rotated to effect heat transfer between air relatively passing the blades and fluid being returned to the reservoir.

U.S. Pat. No. 6,240,247 B1 issued on May 29, 2001 for "Ceiling Fan With Attached Heater And Secondary Fan", U.S. Pat. No. 6,438,322 B1 issued on Aug. 20, 2002 for "Ceiling Fan With Attached Heater And Secondary Fan", and U.S. Pat. No. 6,477,321 B2 issued on Nov. 5, 2002 for "Ceiling Fan Room Conditioner With Ceiling Fan And Heater", all to Reiker, and United States patent application by Reiker for "Ceiling Fan Room Conditioner With Ceiling Fan And Heater" and published on Feb. 21, 2002 with Publication No. US 2002/0021891 A1, all disclose a room conditioner for providing an essentially uniform temperature within a room upon operation of a motor of a ceiling fan. The motor includes a stator supported by a ceiling mounted shaft and a rotor supporting a set of fan blades of the ceiling fan for causing airflow upon energization of the motor. A heating element supported by the shaft and upwardly displaced from the ceiling fan heats air flowing therepast and a secondary fan responsive to the rotor via a sleeve about the shaft draws air past the heating element. Heated air flowing from the heating element is mixed with the airflow caused by operation of the set of fan blades to distribute warmed air uniformly throughout the space of the room wherein the room conditioner is located.

United States patent application by Kosugi et al. for "Ceiling Embedded Type Indoor Unit" and published on Feb. 28, 2002 with Publication No. US 2002/0023455 A1 discloses a ceiling embedded type indoor unit which is reduced in height to provide a compact unit body size and which provides a large cooling/heating capability. The ceiling embedded type indoor unit has two air blowoff posts and embedded in a ceiling comprises a heat exchanger formed in a U-shape with sides of the U-shape being disposed on long sides of a unit body and connected to a header pipe for circulating a coolant at one end of an open side of the U-shape, air blowoff ports disposed to extend from a bottom side the U-shape, and a centrifugal blower disposed aside to the bottom side of the U-shape relative to a substantial center of a length direction of the sides of the U-shape.

U.S. Pat. No. 6,370,970 B1 issued to Sekiguchi et al. on Apr. 16, 2002 for "Air Conditioner" discloses an air conditioner having a centrifugal blower disposed in a central portion within a casing of an air conditioner main body, a beat exchanger disposed around the centrifugal blower, a heat insulation material for forming blow-off air course disposed between the heat exchanger and an inner wall surface of the casing on the inner wall surface, a panel mounted to a lower end portion of the casing, a suction port formed in a central portion of the panel, and a plurality of blow-off posts formed in side edge portions of the panel. The blow-off air course has a narrow portion configured to enhance a uniformity of a velocity distribution of and air flow in the blow-off air course, the guide comprises an acoustic material, and an air layer is provided between the casing and guide.

United States patent application by Downs et al. for "Turbine Blade Tip Cooling Construction" and published on Jan. 30, 2003 with Publication No. US 2003/0021684 A1 discloses a gas turbine blade with a tip squealer having cooling passages that provide cooling fluid for the cooling of the tip squealer. A first portion of the cooling passages extends from an internal hollow space through an end cap to a tip pocket. A second portion of the cooling passage extends from the end cap in part through the rails of the tip squealer to the tip crown. The second portion is partially bounded by the rail and partially open to the tip pocket.

While various types of air circulating fans with cooling functions have been introduced in the past, there is still a need to design and construct a simple and effective air-conditioned ceiling fan apparatus that can be used as an integral unit and mounted on a ceiling inside of a user's house for providing an optimal indoor air circulating and conditioning result.

SUMMARY OF THE INVENTION

The present invention is directed to an air conditioning fan apparatus.

It is an object of the present invention to provide a novel and unique air conditioning fan apparatus for providing a user with cold air by moving the warm air in the upper level of a room through cold blades of the fan that lower the air temperature in the room.

It is also an object of the present invention to provide a novel and unique air conditioning fan apparatus that incorporates an air conditioning unit with a ceiling fan for cooling the blades of the fan so that when the fan blades are circulating the air, they also cool the air being circulated to provide a more effective cooling result.

It is another object of the present invention to provide a novel and unique air conditioning fan apparatus where the air conditioning unit is an integral part of the ceiling fan in that the entire air conditioning unit is suspended from the ceiling and rotates together with the fan blades.

It is also another object of the present invention to provide a novel and unique air conditioning fan apparatus that comforts a user by cooling the lower level of a room and moving the warm air to the upper level of the room.

It is yet another object of the present invention to provide a novel and unique air conditioning fan apparatus that directly cools the fan blades with ultra cold Freon gas that circulates within the fan blade.

It is still another object of the present invention to provide a novel and unique air conditioning fan apparatus that has a condenser located in close proximity of the fan blades so that the cold Freon gas can quickly circulate from the condenser to the fan blades without traveling through long conduits for effective cooling of the fan blade.

It is an additional object of the present invention to provide a novel and unique air conditioning fan apparatus that has a condenser located in the upper level of a room above the fan blades so that the heat released by the apparatus will not be in direct contact with the user in the lower level of the room.

It is also an additional object of the present invention to provide a novel and unique air conditioning fan apparatus that has the entire air conditioning unit rotate together with the fan blades with a simple and reliable Freon circulation structure between the condenser and fan blades.

It is a further object of the present invention to provide a novel and unique air conditioning fan apparatus that has the entire air conditioning unit suspended together with the fan blades so that the integral air conditioning fan can be mounted as and in place of a traditional ceiling fan.

It is another further object of the present invention to provide a novel and unique air conditioning fan apparatus that collects water from the condensate moisture of the air conditioning unit in a reservoir so that the water can be used later for various purposes.

It is yet another further object of the present invention to provide a novel and unique air conditioning fan apparatus that has a timer device for keeping the fan blades rotating for a short while after the air conditioning unit is switched off so that any remaining condensate can be centrifugally expelled into the collecting channel to avoid water dripping onto the users home or offices.

It is still a further object of the present invention to provide a novel and unique air conditioning fan apparatus that circulates only the indoor air without introducing outside air into the home which may be polluted to ensure the indoor air quality.

Described generally, the present invention air conditioning fan apparatus include a ceiling fan unit, an air conditioning unit and a motor unit, all suspended as an integral device to a ceiling inside a user's home or office. The ceiling fan unit includes a multiplicity of fan blades each having evaporator tubing running inside. The air conditioning unit cools Freon gas that circulates through the fan blades for cooling the fan blades as they circulate the indoor air which in turn cools the air being circulated. The motor unit rotates the entire air conditioning unit and the fan blades together. A circular channel is further provided around the outside perimeter of the fan blades for collecting the moisture condensate formed on the fan blades as a result of the operation of the air conditioning unit.

The present invention air conditioning fan apparatus has many advantages. It provides an effective way of cooling the warm air in the upper level of a room through cold blades of the fan to lower the air temperature in the room, without introducing any outside air into the room which may be polluted. Its integral design and construction allows the entire apparatus to be suspended from the ceiling as a conventional ceiling fan. With the condenser unit located in close proximity of and rotating with the fan blades, the cold Freon gas can quickly circulate from the condenser to the fan blades in a simple and reliable circulation structure. It also incorporates a condensed moisture collecting device which allows the water collected to be used later for various purposes, with a timing mechanism that allows the fan blades to keep rotate for certain minutes after the condenser is turned off to have the remaining condensate collected to avoid water dripping onto the users home or offices.

These and other objects, features and advantages of the present invention should become apparent from the following description of the preferred embodiment, taken in conjunction with the accompanying drawings, which illustrate, by way of example, the principles of the present invention.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Although specific and preferred embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Figure 1:
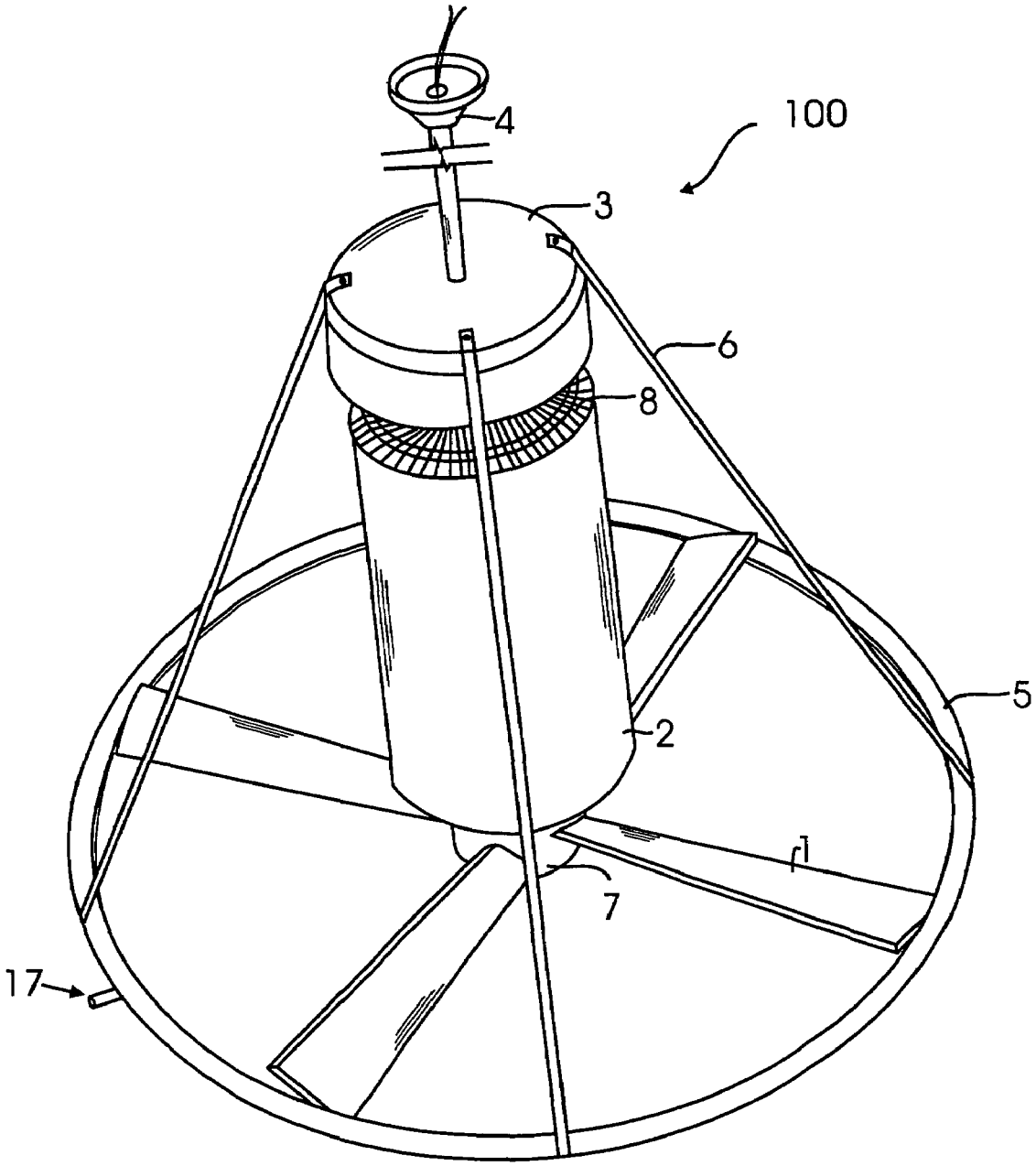
FIG. 1 is an oblique perspective view of the air conditioning fan according to a preferred embodiment of the present invention.
Figure 2:
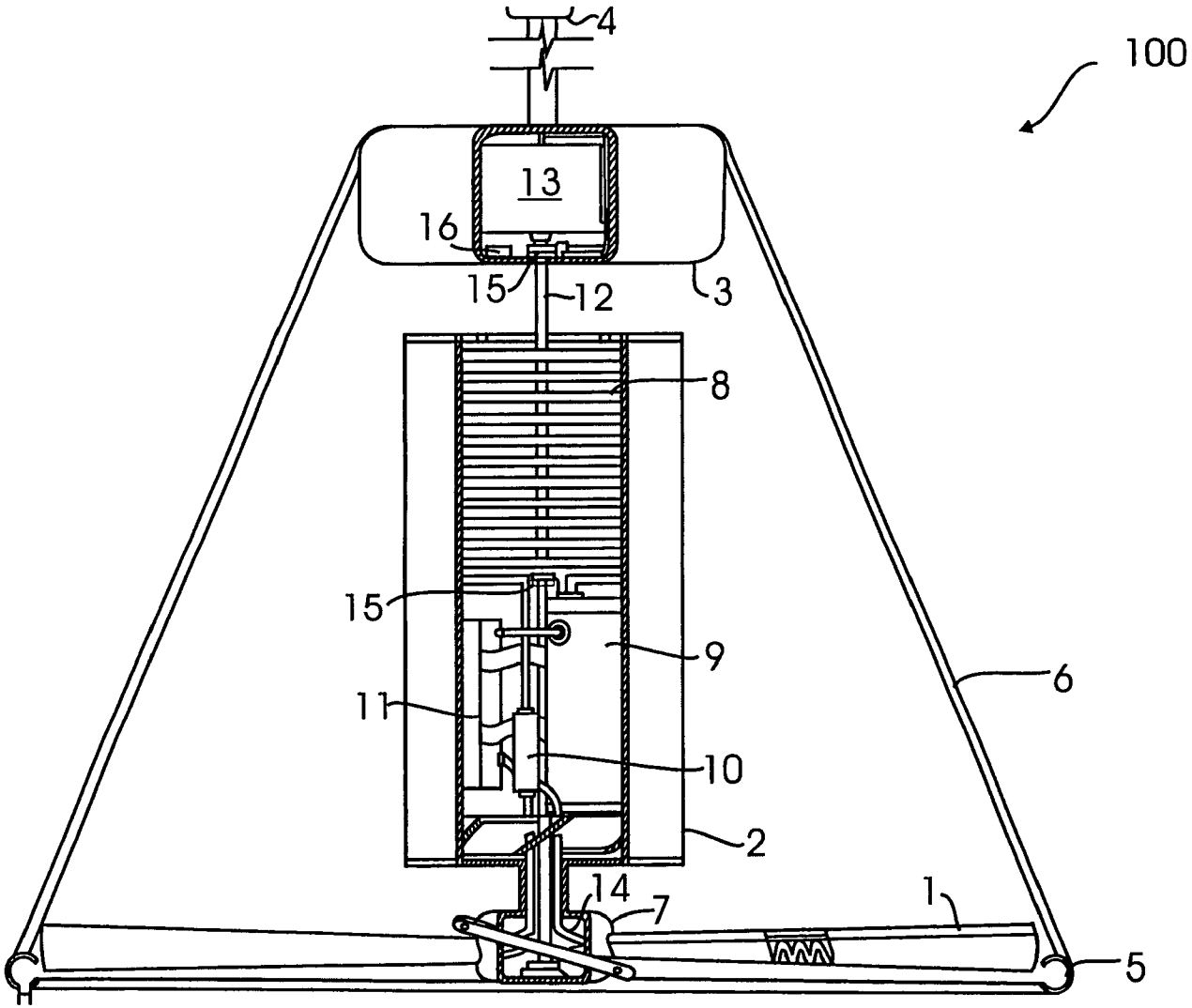
FIG. 2 is a front elevational view of the air conditioning fan depicted in FIG. 1, with cut out views of the gut of the air conditioning system.

Referring to FIGS. 1 and 2, one of the preferred embodiments of the present invention air conditioning fan apparatus is shown and generally referred to by the numeral 100.

In the preferred embodiment shown in FIGS. 1 and 2, the air conditioning fan apparatus 100 of the present invention include a multiplicity of fan blades 1, an air conditioning unit 2, and a motor unit 3, all suspended to a ceiling bracket 4 as an integral device.

The ceiling bracket 4 houses the electrical wiring and hanging assemblies with a cover plate for suspending the entire air conditioning fan apparatus 100 in a manner similar to that of hanging a conventional ceiling fan to a ceiling.

The multiplicity of fan blades 1 are joined at a junction housing 7 which also serves as a housing for evaporator tubing 14 that runs through each of the fan blade 1.

The air conditioning unit 2 includes a condenser 8, a compressor 9, an evaporating valve 10, and an accumulator or dryer 11. The air conditioning unit 22 utilizes Freon gas which circulates through the air conditioning unit 2 and fan blades 1. The compressor 9 compresses the Freon gas in liquid form that is condensed by the condenser 8 and cools before reaching the evaporating valve 10 where the Freon becomes ultra cold gas again. This ultra cold Freon gas then circulates through the tubing 14 inside the fan blades 1 to cool the fan blades 1 as they circulate the indoor air, so that the air being circulated is also cooled.

The motor unit 3 includes an electric motor 13 for driving the rotating shaft 12 which in turn rotates the entire air conditioning unit 2 and the fan blades 1. Because the air conditioning unit 2 and the fan blades 1 are rotating together by a common rotating shaft 12, the arrangement of the tubing 14 between the air conditioning unit 2 and the fan blades 1 is very simple and reliable.

The motor unit 3 also includes a continuous switch 15 for switching on or off the air conditioning unit 2, such that the ceiling fan 1 can be turned on (with an independent switch not shown) with or without the air conditioning unit 2 being switched. A user may choose to switch on the ceiling fan 1 first. When additional cooling is desired, the user may switch on the air conditioning unit. Alternatively, the switch 15 may control both the ceiling fan 1 and the air conditioning unit 2 such that when the user switches on switch 15, both the ceiling fan 1 and the air conditioning unit 2 begin to operate. The switch 15 may be operated by a remote controller (not shown).

The present invention air conditioning fan apparatus 100 also incorporates an arrangement for collecting moisture condensate formed on the fan blades 1 as a result of the operation of the air conditioning unit 2. A circular channel 5 is suspended around the outside perimeter of the fan blades 1 by a plurality of straps 6. The circular channel 5 has an inward facing continuous opening for collecting moisture condensate formed on the fan blades 1. As the fan blades 1 rotate, the moisture condensate formed thereon is centrifugally expelled into the circular channel 5 which also serves as a reservoir of the water collected. A small outlet 17 is provided for dispensing of the water collected in the circular channel 5.

The present invention air conditioning fan apparatus 100 further includes a timer 16 located in the motor unit 3. The function of the timer 16 is to keep the fan blades 1 rotating for a determined number of minutes after the air conditioning unit 2 is switched off, so that any remaining moisture condensate formed on the fan blades 1 can be centrifugally expelled into the circular channel 5. This feature ensures that no water drips onto the users home or offices as a result of the operation of the air conditioning unit 2.

The present invention has many unique and advantageous features and functions. The most important unique and advantageous feature of the present invention is that it provides a user with cold air by moving the warm air in the upper level of a room. Since the air conditioning fan apparatus generates more cold than it does heat, it making the possibility of this invention a reality, as the condenser will be for the first time located inside a room.

An other unique and advantageous feature of the present invention is the location of the condenser at an upper level of the room. As heat rises and the effect of the heat released by the unit will not be in direct contact with the user. Rather, the cooled air is propelled by the fan unit to be in direct contact with the user.

Yet another unique and advantageous feature of the present invention is that it is the first rotating air conditioning system where the entire compressor, condenser, evaporator, valves, tubing, etc . . . are all rotating together with the fan blades. This makes it possible to have a very simplified and reliable design of the circulating tubing between the air conditioning unit and the fan unit.

An additional unique and advantageous feature of the present invention is the provision of the moisture condensate collection channel that collects and stores pure water formed on the fan blades as a result of the air conditioning operation, which water can be later used for many purposes.

A further unique and advantageous feature of the present invention is the incorporation of a timer feature that keeps the fan rotating for a while after the air conditioner is turned off, so that any remaining water drops formed on the fan blade can be collected in the reservoir without dripping onto the users home or offices.

Another important feature of the present invention apparatus is that, contrary to the vast majority of conventional air conditioning systems, the present invention air conditioning fan apparatus does not introduce outside air into the home when it operates, thereby increases the effectiveness and efficiency of the air conditioning system, and maintains and ensures the indoor air quality by eliminating possible air pollution from the outside air.

Of course the present invention is not intended to be restricted to any particular form or arrangement, or any specific embodiment or use, disclosed herein, since the same may be modified in various particulars or relations without departing from the spirit or scope of the claimed invention hereinabove shown and described of which the apparatus shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features, principles or scope of the present invention. Therefore, the invention is to be limited only by the scope of the appended claims.

What is claimed is:

1. An air conditioning fan apparatus to be suspended on a ceiling of an indoor:

room for cooling indoor air of the room, comprising:

a. a multiplicity of fan blades, an air conditioning unit, and a motor unit, all suspended to a ceiling bracket as an integral unit;

b. said ceiling bracket having electrical wiring means and hanging assemblies for suspending said integral unit of said air conditioning fan apparatus to said ceiling;

c. said multiplicity of fan blades joined at a junction housing which also serves as a housing for evaporator tubing means that runs through each of said fan blade;

d. said air conditioning unit having a condenser, a compressor, an evaporating valve and a dryer, and utilizing Freon gas which circulates through said air conditioning unit and said fan blades for cooling said fan blades as they circulate said indoor air so that said air being circulated is also cooled; and e. said motor unit having an electric motor for driving a rotating shaft which in turn rotates said air conditioning unit in its entirety and also said fan blades.

2. The air conditioning fan apparatus in accordance with claim 1, wherein said motor unit further comprises a continuous switch for switching on or off both said ceiling fan and said air conditioning unit.

3. The air conditioning fan apparatus in accordance with claim 1, wherein said motor unit further comprises a continuous switch for switching on or off said air conditioning unit independently.

4. The air conditioning fan apparatus in accordance with claim 1, further comprising means for collecting moisture condensate formed on said fan blades as a result of operating said air conditioning unit.

5. The air conditioning fan apparatus in accordance with claim 4, wherein said means for collecting moisture comprises a circular channel suspended around an outside perimeter of said fan blades by a plurality of straps.

6. The air conditioning fan apparatus in accordance with claim 5, wherein said circular channel has an inward facing continuous opening for collecting moisture condensate formed on said fan blades.

7. The air conditioning fan apparatus in accordance with claim 5, wherein said circular channel has an outlet for dispensing of water collected in said circular channel.

8. The air conditioning fan apparatus in accordance with claim 1, further comprising a timer for said motor unit for keeping said fan blades rotating for a desired period of time after said air conditioning unit is switched off.

9. An air conditioning fan apparatus for cooling surrounding air, comprising:

a. a multiplicity of fan blades, an air conditioning unit, and a motor unit, all suspended as an integral unit;

b. said multiplicity of fan blades joined at a junction housing which also serves as a housing for evaporator tubing means that runs through each of said fan blade;

c. said air conditioning unit utilizing a cooling substance which circulates through said air conditioning unit and said fan blades for cooling said fan blades as they circulate said surrounding air so that said air being circulated is also cooled; and d. said motor unit having an electric motor for rotating said air conditioning unit in its entirety and also said fan blades.

10. The air conditioning fan apparatus in accordance with claim 9, further comprising means for suspending said integral unit of said air conditioning fan apparatus.

11. The air conditioning fan apparatus in accordance with claim 10, wherein said suspending means comprises a ceiling bracket having electrical wiring means and hanging assemblies for suspending said integral unit of said air conditioning fan apparatus to a ceiling.

12. The air conditioning fan apparatus in accordance with claim 9, wherein said motor unit further comprises a continuous switch for switching on or off both said ceiling fan and said air conditioning unit.

13. The air conditioning fan apparatus in accordance with claim 9, wherein said motor unit further comprises a continuous switch for switching on or off said air conditioning unit independently.

14. The air conditioning fan apparatus in accordance with claim 9, further comprising means for collecting moisture condensate formed on said fan blades as a result of operating said air conditioning unit.

15. The air conditioning fan apparatus in accordance with claim 14, wherein said means for collecting moisture comprises a circular channel suspended around an outside perimeter of said fan blades by a plurality of straps.

16. The air conditioning fan apparatus in accordance with claim 15, wherein said circular channel has an inward facing continuous opening for collecting moisture condensate formed on said fan blades.

17. The air conditioning fan apparatus in accordance with claim 15, wherein said circular channel has an outlet for dispensing of water collected in said circular channel.

18. The air conditioning fan apparatus in accordance with claim 9, further comprising a timer for said motor unit for keeping said fan blades rotating for a desired period of time after said air conditioning unit is switched off.

* * * * *